US010874923B2

(12) United States Patent
Schiller

(10) Patent No.: US 10,874,923 B2
(45) Date of Patent: Dec. 29, 2020

(54) TRAINING DEVICE FOR BALL THROWING

(71) Applicant: John P. Schiller, Fenton, MI (US)

(72) Inventor: John P. Schiller, Fenton, MI (US)

( * ) Notice: Subject to any disclaimer, the term of this patent is extended or adjusted under 35 U.S.C. 154(b) by 0 days.

(21) Appl. No.: 14/832,238

(22) Filed: Aug. 21, 2015

(65) Prior Publication Data

US 2016/0051878 A1 Feb. 25, 2016

Related U.S. Application Data

(60) Provisional application No. 62/040,065, filed on Aug. 21, 2014.

(51) Int. Cl.
*A63B 69/00* (2006.01)

(52) U.S. Cl.
CPC .. *A63B 69/0002* (2013.01); *A63B 2069/0006* (2013.01)

(58) Field of Classification Search
CPC ..... A63B 69/0002; A63B 69/0091; A63B 69/0079; A63B 2069/0006; A63B 2102/182
See application file for complete search history.

(56) References Cited

U.S. PATENT DOCUMENTS 1,881,384 A * 10/1932 Albera ..... A63B 69/0091 473/428
2,680,022 A 6/1954 Walden
2,890,049 A * 6/1959 Mac Lewis ..... A63B 69/203 482/87
3,152,803 A 10/1964 Sain, Jr.
3,366,383 A * 1/1968 Lentine ..... A63B 69/0079 473/430
3,469,840 A * 9/1969 Kruzel ..... A63B 69/0084 473/428
3,547,438 A 12/1970 Schmitter
3,558,134 A * 1/1971 Hoitsma ..... A63B 69/0075 473/428
3,630,521 A * 12/1971 Lingbeek ..... A63B 69/0084 473/426

(Continued)

FOREIGN PATENT DOCUMENTS

KR 10-2013-0042800 4/2013
TW M 338679 8/2008
WO 2008/018773 2/2008

OTHER PUBLICATIONS

International Search Report and Written Opinion for corresponding PCT Application No. PCT/US2015/046270, dated Jul. 1, 2016.

*Primary Examiner* — Melba Bumgarner
*Assistant Examiner* — Amir A Klayman
(74) *Attorney, Agent, or Firm* — Gardner, Linn, Burkhart & Ondersma LLP

(57) ABSTRACT

A training device is provided for teaching a desired overhand ball throwing technique. The device includes a guide track, a ball, and a ball mount that attaches the ball to the guide track. The guide track has opposite ends and is configured to be mounted in an elevated or overhead location, with the ball and ball mount traversing between the opposite ends during use. The ball mount may provide multiple degrees of freedom when throwing the ball, while guiding the ball along a desired path as the ball is held in a user's hand and propelled in a throwing manner.

18 Claims, 8 Drawing Sheets

(56) References Cited

U.S. PATENT DOCUMENTS 3,716,235 A * 2/1973 Yerkie, Jr. ..... A63B 69/0079 248/298.1
3,830,494 A 8/1974 Biskup
4,138,107 A * 2/1979 Janis ..... A63B 69/0084 473/426
4,523,762 A * 6/1985 Garner, Sr. ..... A63B 69/0084 473/473
4,592,545 A * 6/1986 Sagedahl ..... A63B 21/0058 473/229
4,640,268 A 2/1987 Roberts
4,773,398 A * 9/1988 Tatom ..... A61H 1/0274 482/139
4,842,270 A * 6/1989 Lange ..... A63B 21/06 473/229
4,948,137 A * 8/1990 Alvarez ..... A63B 69/0084 119/708
5,165,698 A 11/1992 Vanderhye
5,197,933 A * 3/1993 Waters ..... A63B 21/06 482/101
5,348,293 A * 9/1994 Smith ..... A63B 67/10 473/474
5,391,132 A * 2/1995 Greenwald ..... A63B 23/03533 482/114
5,393,050 A * 2/1995 Lloyd ..... A63B 69/0091 473/417
5,403,002 A * 4/1995 Brunty ..... A61F 5/0123 473/438
5,427,369 A * 6/1995 Baquet, Jr. ..... A63B 69/0091 473/429
5,441,255 A 8/1995 Verbick
5,480,141 A * 1/1996 Wood ..... A63B 69/0079 473/140
5,603,681 A * 2/1997 Olschansky ..... A63B 21/04 482/123
6,390,939 B1 * 5/2002 Palacios ..... A63B 69/0002 473/422
6,666,781 B1 * 12/2003 Illis ..... A63B 69/0002 273/317.6
7,056,224 B1 * 6/2006 Keyes ..... A63B 69/3641 473/229
7,217,202 B2 5/2007 Troxell
7,517,290 B1 * 4/2009 Springer ..... A63B 69/0002 473/422
7,857,731 B2 12/2010 Miller et al.
7,935,026 B2 * 5/2011 McSorley ..... A63B 21/0552 482/44
8,801,528 B1 * 8/2014 Dras ..... A63B 69/0079 473/147
9,227,124 B1 * 1/2016 Sparks ..... A63B 69/0002
2007/0049426 A1 * 3/2007 Huang ..... A63B 69/0002 473/417
2012/0258822 A1 * 10/2012 Harvey ..... A63B 69/0002 473/417

* cited by examiner

TRAINING DEVICE FOR BALL THROWING

CROSS REFERENCE TO RELATED APPLICATION

The present application claims the benefit of U.S. provisional application Ser. No. 62/040,065, filed Aug. 21, 2014, which is hereby incorporated herein by reference in its entirety.

FIELD OF THE INVENTION

The present invention relates generally to training devices for physical skills and coordination and, more particularly, to training devices for teaching ball throwing skills.

BACKGROUND OF THE INVENTION

Ball throwing techniques for distance and accuracy are often not intuitive, but are critical to the effective and competitive playing of many team sports, such as baseball and softball. Such sports typically require players to throw balls to one another across long distances at high speed and with great accuracy to play competitively. In addition, improved speed and accuracy, through proper technique, can help reduce the likelihood of injuries to players.

SUMMARY OF THE INVENTION

The present invention provides a training device for ball throwing, in which a ball or ball-substitute is guided along an appropriate throwing path as a user grasps the ball and simulates a throwing motion. The device teaches muscle memory through repetitive use, can be mounted in different locations using brackets or suspension devices, can be positioned at different heights for use by different individual users, and can be made sufficiently large so that two users positioned at opposite ends of the device can use the device for training by throwing the ball back and forth to one another along the training device. In addition, the device may be configured for permanent or semi-permanent installation, such as in dedicated training areas, or can be configured for portability and use in temporary training areas that may have other uses.

According to one form of the present invention, a training device for teaching ball throwing technique includes a guide track, a ball, and a ball mount. The guide track has opposite ends and is mounted in an elevated or overhead location. The ball mount has a track-engaging portion that is movably coupled to the guide track, and has a ball-engaging portion that extends from the track-engaging portion. The ball is coupled to the ball-engaging portion of the ball mount, so that the ball is movably supported along the guide track and is manually throwable from the first end to the second end of the guide track.

In one aspect, the guide track includes a pair of elongate channel members in horizontally spaced arrangement, the ball-engaging portion has opposite end portions supported at respective channel members, and the ball is mounted at a mid portion of the ball-engaging portion, between the channel members. Optionally, a wheeled truck is provided at each of the opposite end portions of the ball mount. The wheeled trucks are movably mounted in respective ones of the elongate channel members, and are free to roll or slide along the channel members as the ball is propelled between the first and second ends of the guide track.

In another aspect, the ball-engaging portion of the ball mount is rotatably coupled to the track-engaging portion of the ball mount.

In yet another aspect, the ball-engaging portion of the ball mount includes a ball strut having an upper end portion coupled to the track-engaging portion and a lower end portion coupled to the ball, wherein the track-engaging portion of the ball mount includes a strut mount to which the upper end portion of the rod is pivotably coupled.

In a further aspect, the strut mount includes a pivot-stop element that limits a range of rotation of the ball strut in the strut mount. Optionally, the pivot-stop element includes at least one selecting pin and the strut mount defines first and second openings spaced apart from one another, with each of the openings configured and positioned to selectively receive the selecting pin. In this arrangement, the ball strut is pivotable about a first range of rotation when the selecting pin is in the first opening, and the ball strut is pivotable about a second range of rotation when the selecting pin is in the second opening. Optionally, the first and second openings are positioned so that the first range of rotation does not overlap the second range of rotation.

In still another aspect, a strut pin projects outwardly from the ball strut so as to selectively engage the selecting pin, to thereby limit the range of rotation of the ball strut in the strut mount.

In a still further aspect, the ball strut is a generally L-shaped rod having its lower end portion angled relative to its upper end portion. Optionally, there is a ball sleeve rotatably mounted at the lower end portion of the ball strut, and the ball defines a bore for receiving the ball sleeve, such as in a friction-fit arrangement.

In another aspect, the track-engaging portion of the ball mount includes at least one sliding block coupled to a side plate. The sliding block defines an opening for slidably receiving the guide track, the ball-engaging portion is coupled to the side plate, and the ball mount and the ball are rotatable about a longitudinal axis of the guide track.

In still another aspect, the training device further includes a support structure having at least two hook portions coupled to the guide track, where the hook portions are configured to engage a substantially vertical support surface to thereby support the training device in a substantially fixed location. Optionally, the support structure includes a pair of end members extending at right angles to the first and second ends of the guide track, with a pair of upright support members extending upwardly from respective ones of the first and second ends of the guide track, and with the hook portions disposed at upper end portions of the upright support members.

In another aspect, the upright support members are pivotably coupled to the end members and the end members are pivotably coupled to the first and second ends of the guide track. The training device is configurable to a collapsed configuration with the upright support members adjacent the end members and the end members adjacent the first and second ends of the guide track. The upright support members, the end members, and the first and second ends of the guide track each define respective longitudinal axes that are substantially parallel to one another in the collapsed configuration.

According to another form of the present invention, a training device for teaching ball throwing technique includes a support structure that is mountable to a vertical support surface, an elongate guide track, a ball mount, and a ball. The elongate guide track is coupled to the support structure and has opposite ends. The ball mount has a track-engaging portion coupled to the guide track and a ball-engaging portion rotatably coupled to the track-engaging portion, and the ball is rotatably coupled to the ball-engaging portion. The track-engaging portion is configured to simultaneously move both linearly along the guide track, and rotatably about a longitudinal axis of the guide track.

In one aspect, the ball-engaging portion of the ball mount includes a ball strut having an upper end portion coupled to the track-engaging portion and a lower end portion coupled to the ball. The track-engaging portion of the ball mount includes a strut mount to which the upper end portion of the rod is pivotably coupled, and a pivot-stop element is provided at the strut mount, the pivot-stop element limiting a range of rotation of the ball strut in the strut mount.

In another aspect, the training device further includes a pair of end members extending at right angles to the first and second ends of the guide track, a pair of upright support members extending upwardly from respective ones of the first and second ends of the guide track, and hook portions coupled to upper end portions of the upright support members. The hook portions are configured to engage a support surface to thereby support the training device at an elevated location, such as along a wall or wall bracket, or a chain-link fence, for example.

Thus, the training device of the present invention provides an apparatus for use in teaching muscle memory for a desired overhand throwing technique by guiding a ball along a substantially predetermined path as it is grasped and thrown by a user. A ball mount that supports the ball along a guide track forces the ball to substantially maintain the predetermined path. However, alternative designs permit at least minor deviations of the ball from the predetermined path. The device may be used by one user alone, or by one user with an assistant, or by two users positioned at opposite ends of the device.

These and other objects, advantages, purposes and features of the present invention will become apparent upon review of the following specification in conjunction with the drawings.

DESCRIPTION OF THE PREFERRED EMBODIMENTS

Figure 1:
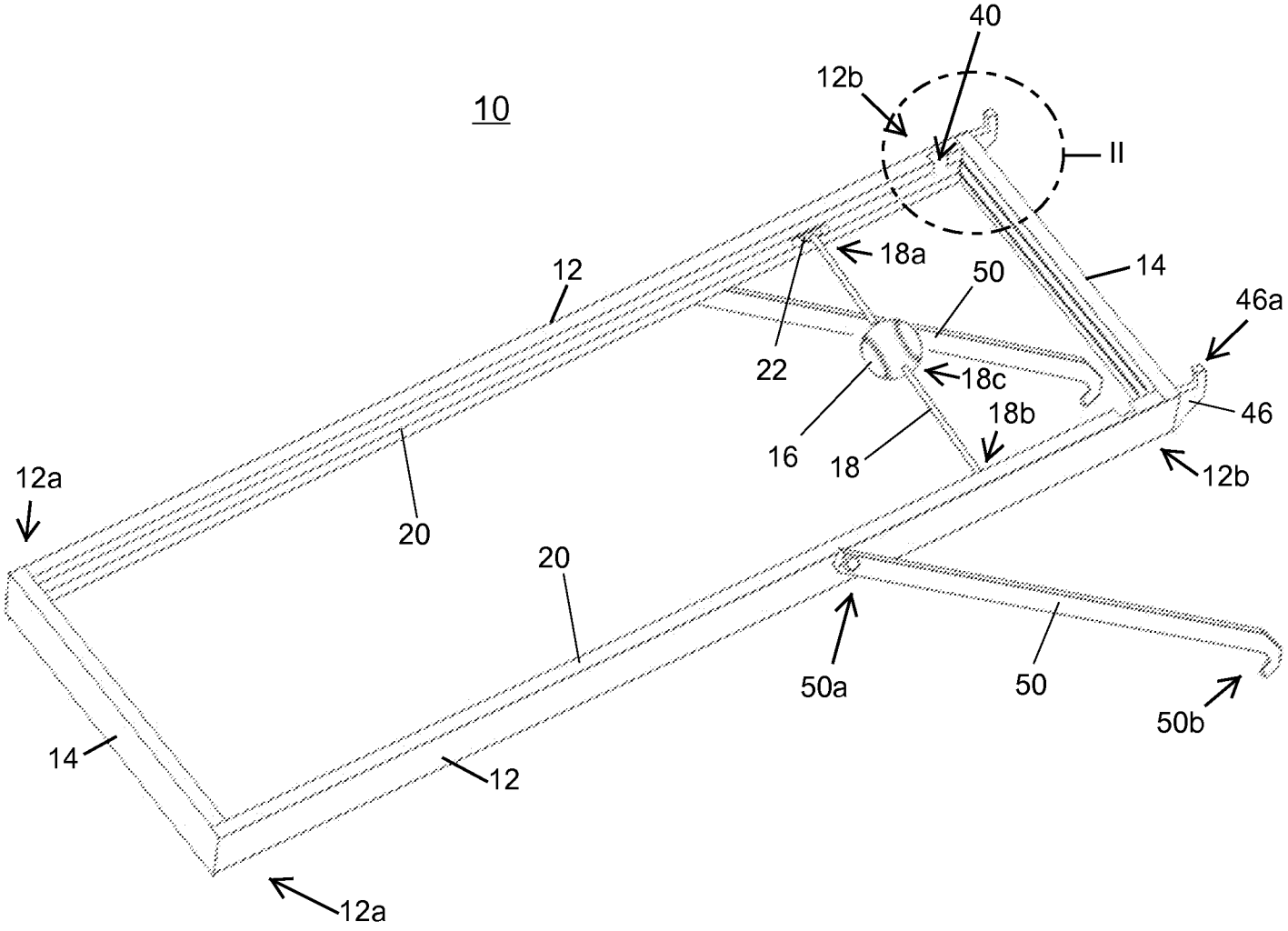
FIG. 1 is a top perspective view of a training device in accordance with the present invention.

Referring now to the drawings and the illustrative embodiments depicted therein, a training device 10 for ball throwing includes a pair of spaced-apart elongate guide tracks 12 having opposite ends 12*a*, 12*b* and a pair of cross members 14 forming a rectangular framework, such as shown in FIG. 1. A ball or ball-like member 16 is supported on a ball mount 18 that, in the illustrated embodiment of FIG. 1, is a substantially rigid rod or shaft having opposite end portions 18*a*, 18*b* received in respective channel members 20 disposed along interior surfaces of guide tracks 12. Ball 16 is supported on a ball-engaging mid-portion 18*c* of ball mount 18, with ball 16 being rotatable relative to guide tracks 12 to facilitate a natural throwing feel as ball 16 leaves the hand of a user during use of the device 10. As will be described in more detail below, ball 16 is movable between guide tracks 12, from a first end 12*a* to the opposite end 12*b*, and is guided along its path via engagement of the ball mount end portions 18*a*, 18*b* in the respective channel members 20 during throwing of ball 16.

Figure 4:
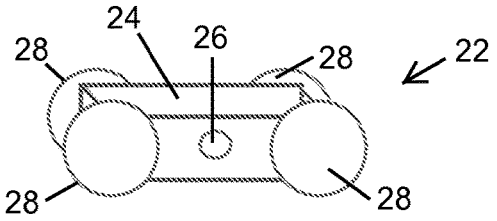
FIG. 4 is a side perspective view of a wheeled truck of the training device of FIG. 1.

End portions 18*a*, 18*b* of ball mount 18 move freely along the respective channel members 20, so that the act of grasping and throwing ball 16 has a natural feel to a user. To facilitate free movement of ball mount 18 along channel members 20, a track-engaging wheeled truck 22 (FIG. 4) may be provided at each end portion 18*a*, 18*b*. In the illustrated embodiment, wheeled truck 22 includes a body portion 24 defining an opening or bore 26 for receiving one of the ball mount end portions 18*a*, 18*b*, which may be either rotatable or fixed in the respective openings or bores 26. In the illustrated embodiment, four wheels 28 are mounted to body portion 24, to facilitate rolling of the wheeled truck 22 along a respective channel member 20. Although wheels 28 are configured to rotate about substantially horizontal axes, it is envisioned that one or more wheels may be oriented so as to rotate about a substantially vertical axis, to facilitate movement of the wheeled truck under side loads and/or twisting loads that may be imparted to ball mount 18 by a user grasping ball 16.

Figure 4A:
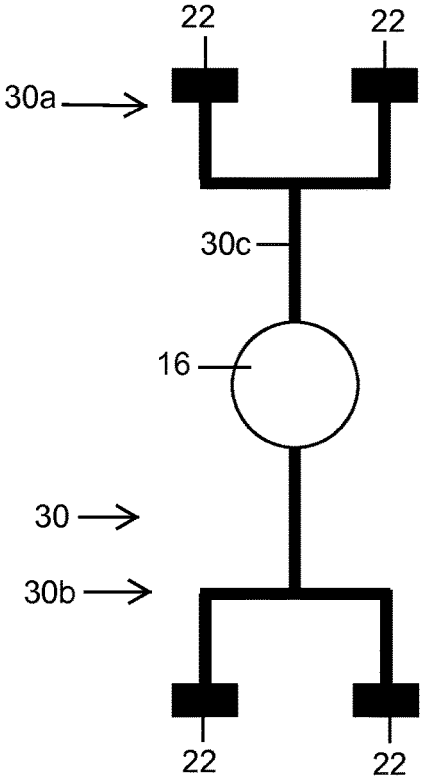
FIG. 4A is a diagrammatic view of an alternative ball mount arrangement for use with the training device.
Figure 4B:
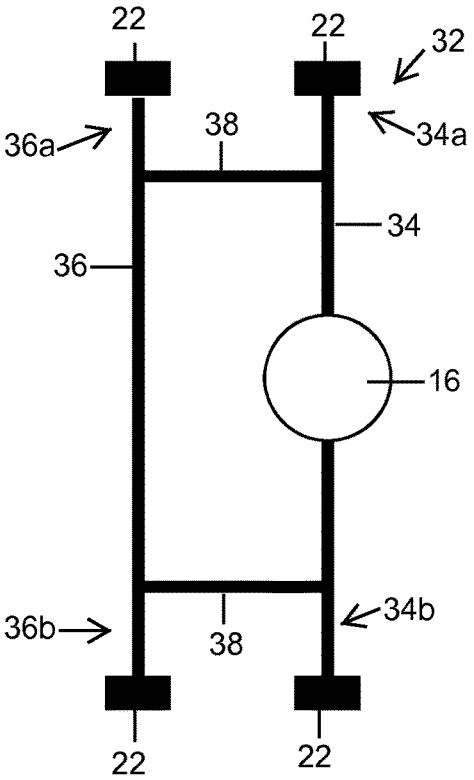
FIG. 4B is a diagrammatic view of another alternative ball mount arrangement for use with the training device.

Different configurations of ball mounts are also envisioned, such as shown in FIGS. 4A-B. Alternative configurations include a ball mount 30 having branched end portions 30*a*, 30*b*, each having a pair of wheeled trucks 22 (FIG. 4A). A mid-portion 30*c* receives ball 16 in a similar manner as with ball mount 18. In another arrangement, a ball mount 32 includes a first shaft 34 to which ball 16 is mounted, and a second shaft 36 that parallels first shaft 34, and is joined to the first shaft 34 by a pair of braces 38 (FIG. 4B). First shaft 34 has a pair of wheeled trucks 22 mounted at opposite end portions 34*a*, 34*b*, and supports ball 16 at a mid-portion 34*c*. Similarly, second shaft 36 has a pair of wheeled trucks 22 that are mounted at opposite end portions 36*a*, 36*b*. The wheeled trucks 22 located at each end of ball mount 32 ride along respective channel members 20, and stabilize ball mount 32 as ball 16 is grasped and thrown along guide tracks 12, while limiting or preventing binding and undesired twisting.

Figure 2:
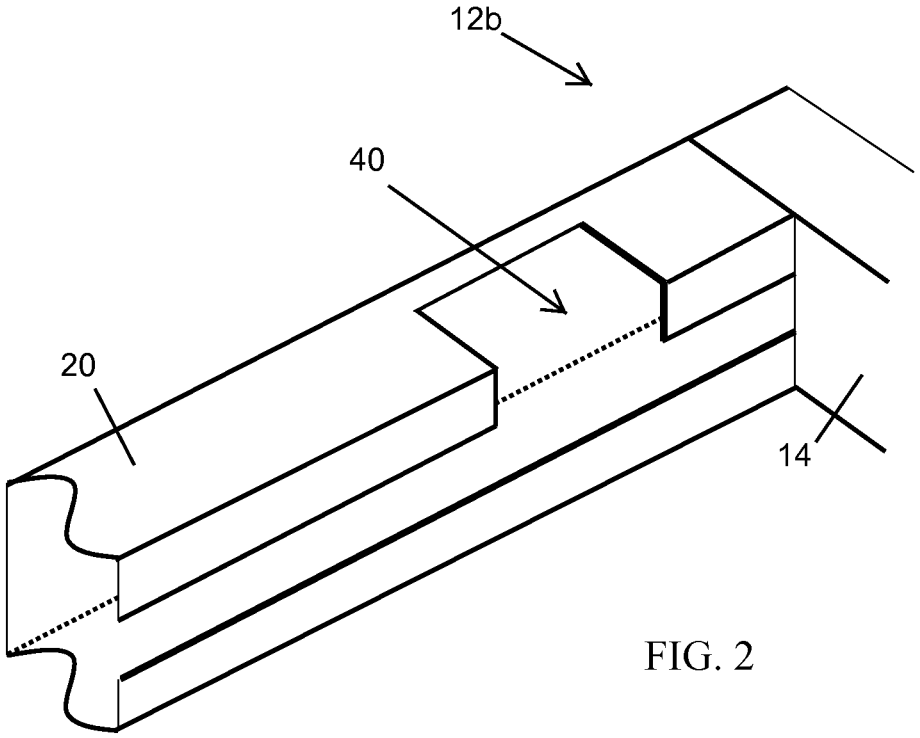
FIG. 2 is an enlarged view of the general area designated II in FIG. 1.
Figure 3:
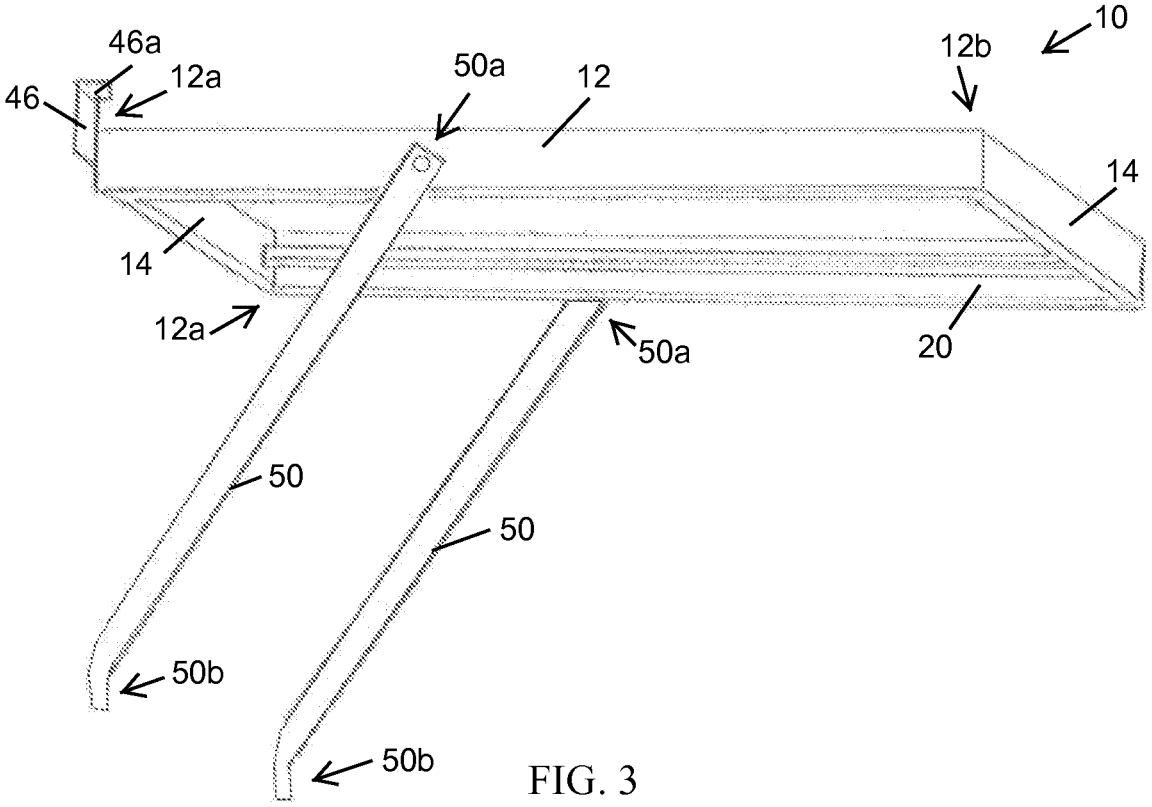
FIG. 3 is a bottom perspective view of training device of FIG. 1, with the ball and ball mount removed.

It is envisioned that any ball mounts 18, 30, 32 may be removed by disengaging the respective end portions (with or without wheeled trucks 22) from channel members 20, which are generally C-shaped in cross section and define an open elongate slot along their inboard sides. Removal of the ball mounts 18, 30, 32 may be accomplished by removing one of cross members 14 from the ends of guide tracks 12, thus exposing open ends of channel members 20. Optionally, each channel member 20 includes an opening or openable portion 40 (FIGS. 1-2) that permits the end portions of a given ball mount, and/or its associated wheeled trucks 22, to be aligned with the opening or openable portion 40 and lifted upwardly to disengage channel members 20. This permits ball mounts to be exchanged or replaced, such as for changing the type of ball that is mounted at the training device.

Although channel members 20 are shown and described as being substantially rigid elongate C-shaped members that are disposed along inboard surfaces of respective guide tracks 12, it is envisioned that other arrangements may be used to provide a similar function. For example, a taut cable or cord may extend between cross members 14, along guide tracks 12, and a ball mount fitted with a pulley at each that rides freely along the respective cable or cord. The guide tracks 12 themselves may also incorporate a suitable feature, such as a channel or track, to facilitate movement of the ball mount and ball from one end of the training device to another.

Optionally, the shaft to which the ball is mounted may be a split-shaft with separate pieces that are inserted into respective bores, or in to respective openings on opposite sides of a single bore. Such an arrangement can facilitate the installation of different types of balls along a single shaft, without need for keeping a separate ball mount for each type of ball. Ball 16 is rotatable along a given ball mount 18, 30, 32 so that the ball 16 can spin (typically a back-spin) as it leaves the user's hand during the throwing motion. Optionally, the ball and/or the ball mount may be configured to provide additional degrees of freedom for the ball to rotate and/or translate relative to guide tracks 12 and cross members 14. For example, the ball may be permitted to rotate not only about a horizontal lateral axis defined through the ball mount (i.e., parallel to cross members 14), but also about a horizontal longitudinal axis that is substantially parallel to guide tracks 12, thus allowing rotation of the user's hand about the horizontal longitudinal axis prior to and during a throw, and allowing backward rotation of the hand and ball together as the throwing arm moves forward.

It is further envisioned that channel member 20 may incorporate a drag device to slow the ball 16 as it approaches the end 12*a* or 12*b* to which it is thrown. Padding or springs or the like may also be used to slow the ball 16 after it has been thrown, to reduce peak stresses on the device and thereby limit wear or damage to the device 10 during use. Optionally, such padding or springs may be arranged in such a way as to cause the ball 16 to bounce at the end of its travel and return to the thrower, thus obviating the need to manually retrieve the ball 16 or to have a second person return the ball to the user.

In the illustrated embodiments of FIGS. 1-5, the shafts to which ball 16 may be mounted are typically rigid shafts and may be made of steel, aluminum alloy, fiberglass, carbon fiber, or the like. The shaft is preferably very strong and/or resistant to plastic deformation. It is also envisioned that, in place of a substantially rigid shaft, a flexible ball mount may be used, such as a pair of springs, bungee cords, or shafts of natural or synthetic rubber or rubber-like materials, which would permit the ball to deviate more from the path defined by guide tracks 12. In such an arrangement, each flexible ball mount may be coupled at its inboard end to an opposite side of the ball by a swivel and/or clip, and may be coupled at its outboard end to a wheeled truck 22, for example. It will be appreciated that ball 16 may be configured to be of substantially the same materials, construction, and weight of a standard baseball or softball, for example, or substantially any other ball or projectile that is manually thrown. Moreover, various different balls may be produced and configured for interchangeable use with the training device 10, so that a desired ball may be selected and installed according to a user's preferences and training needs. Different balls may be attached to a given ball mount, or the different balls may each be permanently or semi-permanently mounted to a respective ball mount and mounted or replaced as a unit to guide tracks 12.

Figure 5A:
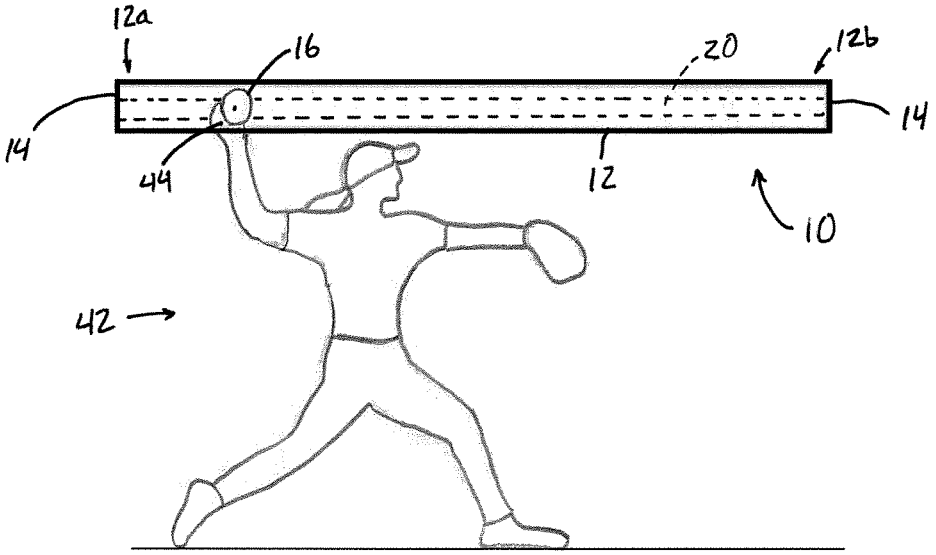
FIGS. 5A-5C are side elevations of the training device in which a user is shown at three progressive stages of throwing a ball using the device.
Figure 5B:
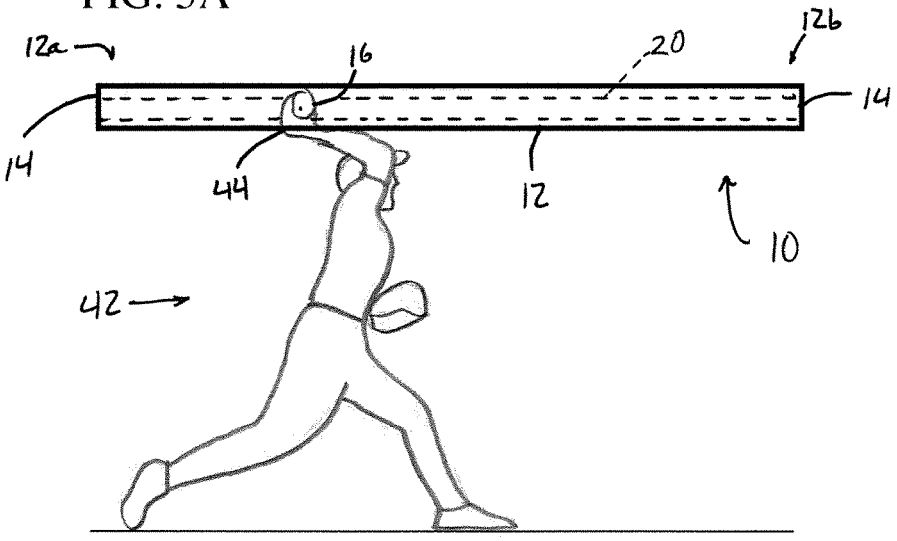

To use training device 10, a user 42 steps under training device 10 (such as at one end 12*a*), grasps ball 16 in a throwing hand 44, and begins a throwing motion, such as shown in FIG. 5A. User 42 follows through with the throwing motion by hurling ball 16 toward the opposite end 12*b* of training device 10, with ball 16 being guided along channel members 20, such as shown in FIG. 5B. User 42 finishes the throwing motion by releasing ball 16 from hand 44 (FIG. 5C), so that ball 16 continues toward the opposite end of training device 10, and stops at cross member 14. An assistant may then return ball 16 to user 42 in a similar manner, or the ball 16 may bounce back to the user as described above, and the process repeated. Optionally, the training device may be further elongated to facilitate use by two users 42 positioned at opposite ends of the training device and facing one another, to facilitate throwing ball 16 back and forth.

Different methods and components are envisioned for mounting training device 10 in elevated or overhead locations, either indoors or outdoors. For example, and with reference to FIGS. 1 and 3, a pair of generally hook-shaped brackets 46 are mounted at a rear of training device 10, one at each guide track end 12*a*. Brackets 46 may be coupled to guide tracks 12 or cross member 14 by any suitable method, such as screws, bolts, or the like, and include an upper end portion 46*a* that projects forwardly, such as to facilitate inserting each bracket 46 into an opening of a chain-link fence, with upper portion 46*a* projecting forwardly through an adjacent opening located directly above, so that each bracket 46 hooks around a respective wire portion of the fence. To support vertical loads applied to training device 10, including due to gravity, a support brace 50 is attached to each guide track 12. Support brace 50 has an upper end portion 50*a* that is pivotally coupled to guide track 12, and a lower end portion 50*b* with a forward-projecting hook shape to engage the fence in a similar manner as hook-shaped brackets 46.

When support brace 50 is not in use, it can be pivoted to be parallel along the respective guide track 12 to which it is mounted, such as with lower end portion 50*b* located near end portion 12*b* of guide track 12, so that training device 10 is more compact for transportation or storage. Support brace 50 may also be removable and/or of a collapsible construction, to facilitate transportation and storage.

Optionally, support braces 50 could be pivoted upwardly so that end portion 50*b* couples to the fence above brackets 46, but such an arrangement may require the use of a ladder, and could therefore be less convenient. However, in the embodiment of FIG. 6, a dual bracket arrangement includes a pair of upper brackets 52 and a pair of lower brackets 54, with each bracket 54 projecting laterally outboard from one of guide tracks 12, such as for engaging openings in a fence for other substantially vertical support surface. Upper bracket 52 is formed at an outboard end of a diagonal brace 56, while lower brackets 54 are formed at a lower end portion of a generally vertical brace 58 that extends downwardly from diagonal brace 56 near upper bracket 52, and attaches to the guide track 12 located directly below. Optionally, another diagonal brace 60 extends from a lower region of vertical brace 58 to approximately the mid-point of brace 56, and provides additional bracing and stiffness when upper and lower brackets 52, 54 are in use. It is also envisioned that one or more flexible wires or cables could be used in place of overhead support braces, which may be less costly to manufacture and easily collapsible for transportation and storage.

Figure 6:
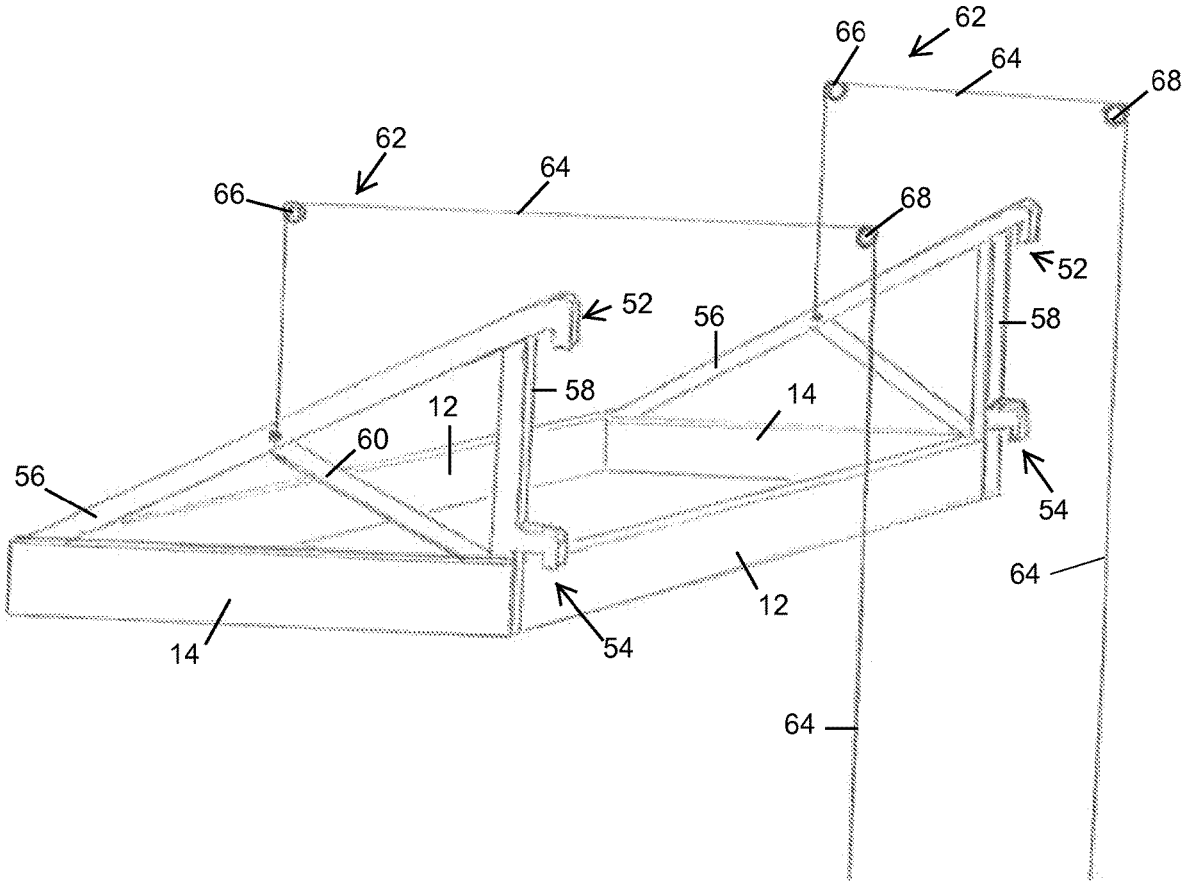
FIG. 6 is a perspective view of a framework of the training device of FIG. 1 mounted by a suspension device.

Optionally, and with reference to FIG. 6, an overhead suspension system 62 may be used where overhead structural supports are available, such as ceiling or floor joists, rafters, or the like. Suspension system 62 includes a pair of cables 64 routed around overhead pulleys 66 and coupled to training device 10, such as where diagonal brace 56 is coupled to diagonal brace 60. In the illustrated embodiment, each cable 64 is routed around a side pulley 68 that is laterally outboard of one of guide tracks 12, so that cables 64 may be routed downwardly from side pulleys 68 and tied off or secured to set a desired height of training device 10 above a floor or other support surface where a user is standing. This arrangement permits the user to adjust the height of training device 10 by paying out more cable 64 to lower the device, or to draw in more cable to raise the device, and then fix the cable to set the device height during use. Optionally, overhead suspension system 62 may be used in conjunction with upper and lower brackets 52, 54, where cable 64 and overhead pulleys 66 provide most or all of the vertical support, and the upper and lower brackets 52, 54 provide stability, lateral support, and longitudinal support to limit or prevent shifting of training device 10 as ball 16 is thrown.

Figure 7:
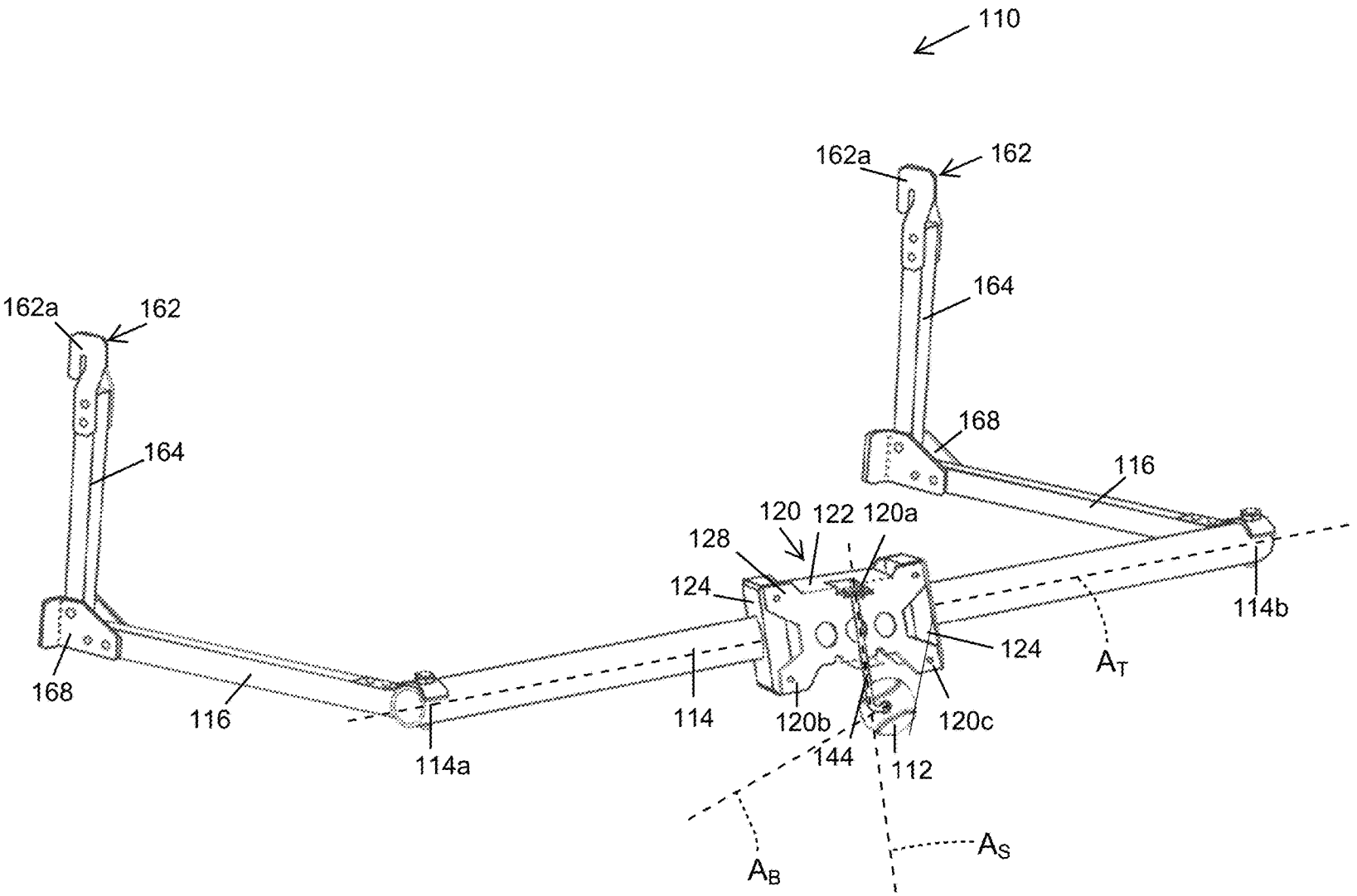
FIG. 7 is a side perspective view of another training device in accordance with the present invention.
Figure 8:
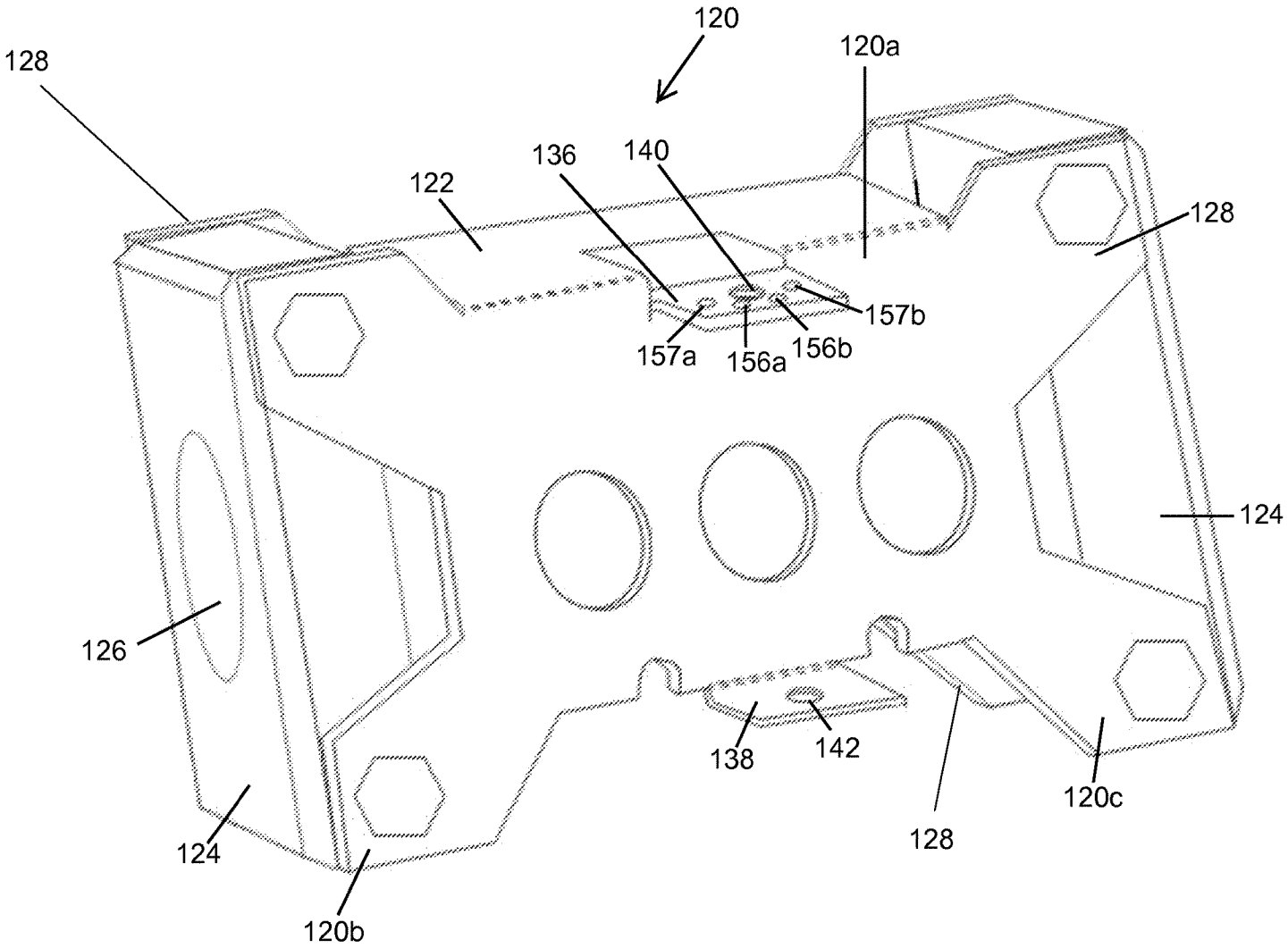
FIG. 8 is a side perspective view of a track-engaging portion of a ball mount of the training device of FIG. 7.

Referring now FIGS. 7-10, another training device 110 includes a ball 112 that is thrown along an elongate guide track 114 having opposite ends 114*a*, 114*b*, and an end member 116 extending at right angles to ends 114*a*, 114*b* to form a three-sided framework. A ball mount 120 supports the ball 112, and slides or otherwise moves longitudinally along guide track 114 as the ball 112 is thrown by a user. The ball mount 120 includes a track-engaging portion 122, having a pair of sliding blocks 124 at opposite ends of a pair of side plates 128, and a ball-engaging portion in the form of a ball strut 144 pivotably coupled to one of the side plates 128 and pivotable about a ball strut axis or ball mount axis $A_S$, and rotatably supporting the ball 112, which is coupled to the ball-engaging portion 144 and rotatable about a ball rotation axis $A_B$. The ball mount 120 is also rotatable around a longitudinal axis $A_T$ of the guide track 114, which provides another degree of freedom for ball 112. The ball mount axis $A_S$ is angled relative to the longitudinal axis $A_T$ of the guide track 114, with the ball rotation axis $A_B$ being angled relative to the ball mount axis $A_S$ and spaced from the longitudinal axis $A_T$ of the guide track 114. The ball's ability to rotate on ball strut about the ball rotational axis $A_B$, to pivot relative to the guide track 114 about the ball strut axis $A_S$, and to rotate about the guide track 114 about the guide track axis $A_T$, facilitates a natural throwing feel as ball 112 leaves the hand of a user during use of the device 110 (FIGS. 7-8).

Each of the sliding blocks 124 is located on a respective side of a mid-portion 120*a* of the ball mount 120, at respective opposite end portions 120*b*, 120*c* thereof, with the sliding blocks 124 coupled to the side plates 128 and arranged in parallel and in axial alignment with one another. Sliding blocks 124 each define an opening or bore 126 (FIG. 8) for receiving and sliding along the guide track 114, the bores 126 having a similar size and shape as the outer surface of the guide track 114 to facilitate sliding.

The sliding blocks 124 are configured with square or rectangular outer surfaces and circular bore surfaces that slide along the guide track 114, which has a circular outer surface. It will be appreciated that circular bores 126 permit rotation of ball mount 120 relative to guide track 114. However, it is envisioned that the sliding blocks may have other outer shapes, such as circular, and may have different bore shapes to match an outer profile or shape of the guide track. In addition, the slide blocks may incorporate wheels or rolling members or surfaces to facilitate movement of the ball mount along the guide track 114.

Figure 9:
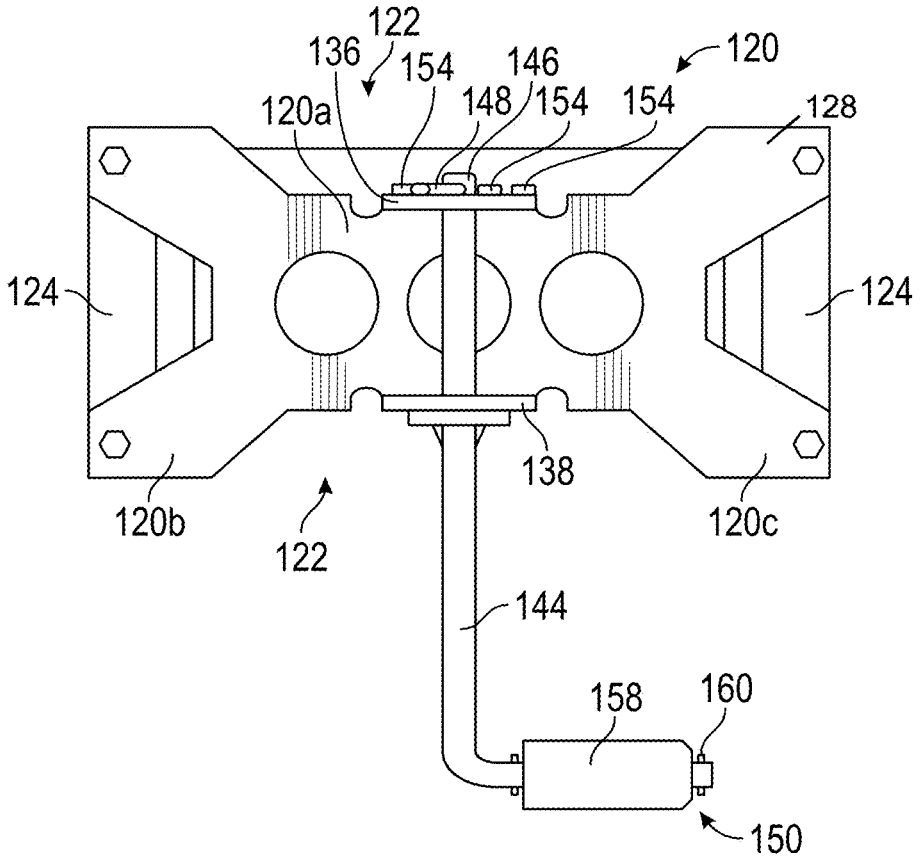
FIG. 9 is a side elevation of the ball mount of the training device of FIG. 7, with the ball removed to show underlying structure.

At least one of the side plates 128 includes a strut mount in the form of a first tab projection 136 and a second tab projection 138 near a mid-portion 120*a* between the ends 120*b*, 120*c* (FIGS. 8 and 9). Each of the tabs 136, 138 are bent at approximately 90 degrees relative to the other portions of the side plate 128, with first tab 136 including a first aperture 140 and second tab 138 including a second aperture 142 for receiving respective portions of the ball strut 144, which is generally J-shaped or L-shaped. A linear first or upper end 146 of the ball strut 144 is rotatably coupled to the first aperture 140 with a strut pin 148 (FIGS. 9-10) that extends radially outwardly from the first end 146. The ball strut 144 passes through the second aperture 142, and the ball 112 is coupled to a second or lower end 150 of the ball strut 144 that is bent at an angle relative to the first or upper end 146. The ball mount's track-engaging portion 122 is formed of substantially rigid materials, such as metal and/or resinous plastics, or a combination thereof. The side plates 128 may be unitarily formed by stamping or otherwise forming from sheet metal to facilitate joining with fasteners to the sliding blocks 124 and the ball strut 144. Alternatively, the track-engaging portion may be formed of multiple pieces (e.g., separate side plates) and joined together, such as by welding, mechanical fasteners, adhesives, or the like.

Figure 10:
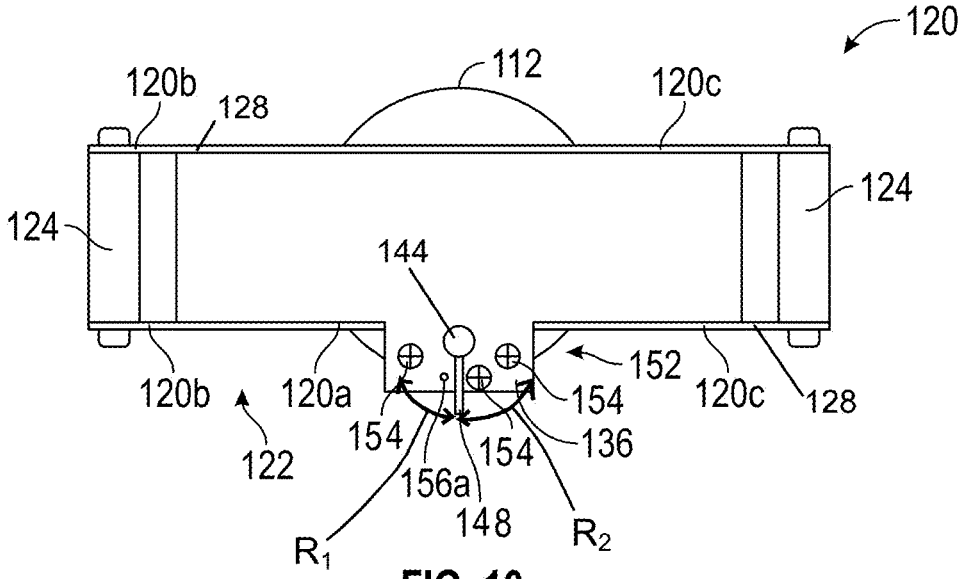
FIG. 10 is a top view of the ball mount of the training device of FIG. 7.

Referring to FIGS. 9-10, the first tab 136 also includes a position selector 152 that permits adjustment of the position and range of pivoting movement of the ball 112 for users who are right- or left-handed. The position selector 152 includes a set of four pinholes 156*a*, 156*b*, 157*a*, 157*b* (FIG. 8) and at least two pivot-stop elements in the form of selecting pins or screws 154 (FIGS. 9 and 10) that are configured to limit a range of rotation of the ball strut 144 in the strut mount 136. Referring to FIG. 8, an inner pair of pinholes 156*a*, 156*b* are located on the first tab 136, closer to the ball strut 144 and located on either side of a midline of the side plates 128. An outer pair of pinholes 157*a*, 157*b* are spaced further from the ball strut 144 and also on either side of the midline.

As will be understood with reference to FIG. 10, only two selecting pins 154 are needed to limit the pivoting movement of the ball strut 144 via engagement by the strut pin 148.

Selecting pins 154 are typically positioned in both outer pinholes 157*a* and 157*b* and may remain there during either left- or right-handed operation. An additional selecting pin 154 is positioned in a desired one of the inner pinholes 156*a*, 156*b* based on whether left- or right-handed operation is desired. Thus, with a selecting pin 154 in the inner pinhole 156*b*, strut pin 148 is free to sweep across the other inner pinhole 156*a* along a first range of pivoting or rotation $R_1$, between the selecting pins in the outer pinhole 157*a* and the inner pinhole 156*b*, such as shown in FIG. 10. With a selecting pin 154 in the other inner pinhole 156*a*, strut pin 148 is free to sweep across the inner pinhole 156*b*, between the selecting pins 154 in the outer pinhole 157*b* and the inner pinhole 156*a* along a second range of rotation $R_2$ that does not overlap the first range of pivoting or rotation $R_1$. If desired, the strut pin 148 may be positioned between two adjacent ones of the pinholes 156*a*, 156*b*, 157*a*, 157*b* that are fitted with selecting pins 154, to further limit or restrict the pivoting movement of the ball strut, such as for use during certain throwing drills in which less freedom of movement is desired.

A cylindrically-shaped ball sleeve 158 is coupled to the second end 150 of the ball strut 144 distal from the ball mount 120, such as shown in FIG. 9. The ball sleeve 158 is rotatably coupled to the ball strut 144 with a sleeve pin 160, and permits the ball 112 to rotate around the lower end 150 of the ball strut 144 when the ball is thrown. The sleeve 158 may be made of nylon for smooth rotation about the lower end 150 of the ball strut 144, although it will be appreciated that bearings or bushings of metal or other suitable materials may be used.

The ball 112 has an opening or bore that receives the ball sleeve 158 in a friction-fit arrangement. The installation of the ball 112 along ball sleeve 158 is facilitated by a chamfered end of the ball sleeve, and also may be facilitated by at least slight deformability of the ball material that defines its opening or bore. Thus, the ball 112 may be replaced along ball strut 144 simply by pulling the ball off of the ball sleeve 158 with sufficient force to overcome friction. Optionally, a light adhesive or the like may be used to help retain the ball 112 at the ball sleeve 158.

It is further envisioned that the ball 112 could be permanently or semi-permanently attached to the ball sleeve 158, such as with a strong adhesive or high-friction engagement, so that the ball 112 and ball sleeve 158 may be replaced as a unit by decoupling the ball sleeve 158 from the ball strut 144. This may be accomplished by first removing the sleeve pin 160 so that ball sleeve 158 is free to slide off the lower end 150 of the ball strut 144.

The ball sleeve 158 may receive many sizes of balls 112, such as a standard size (9.25 inch) baseball, small (11 inch) softball, standard (12 inch softball), or the like. Moreover, various different balls 112 may be produced and configured for interchangeable use with the training device 110, so that a desired ball 112 may be selected and installed according to a user's preferences and training needs. Different balls 112 may be coupled with the ball sleeve 158 and attached to the given ball mount 120, or the different balls 112 may each be permanently or semi-permanently mounted to a respective ball mount 120 and mounted or replaced as a unit to the guide track 114. Removal of the ball mount 120 may be accomplished by removing one of end members 116 from the ends 114*a* or 114*b* of guide track 114, thus exposing open ends of end members 116. This permits ball mount 120 to be exchanged or replaced, such as for changing components of the ball mount, including the slide blocks 124 and slide plates 128, or the ball 112.

The guide track 114 is a substantially rigid channel member, rod, or shaft in which the opposite ends 114*a*, 114*b* are coupled to respective end members 116 on either end of the guide track 114 with fasteners, such as threaded bolts, button spring pins, or push pins. The use of button spring pins or push pins permits easier disassembly or breakdown of the device 110, such as by pivoting the members 116 inward to be substantially parallel with the guide track 114. In addition, fasteners may include a threaded bolt and wing nut to tighten each of the end members 116 to the guide track 114. Optionally, the guide track 114 may incorporate a drag device to slow the ball 112 as it approaches the end 114*a* or 114*b* to which it is thrown, such as in a manner described above with respect to channel members 20 of device 10.

Different methods and components are envisioned for mounting training device 110 in overhead locations, either indoors or outdoors. For example, and with reference to FIG. 7, a pair of generally hook-shaped brackets 162 are mounted to a pair of upright or vertical support members 164 that extend upwardly from respective end members 116. Lower ends 168 of the vertical support members 164 are coupled to respective end members 116. Each of the end members 116 and vertical support members 164 in the illustrated embodiment are oriented at right angles using right angle plates 168 and fasteners, such as threaded bolts. It will be appreciated that end members 116, vertical support members 164, and hooks 162 cooperate to form a support structure that is capable of supporting the guide track 114 and ball mount 120 in a substantially fixed location relative to a support surface, such as a fence or wall.

Figure 5C:
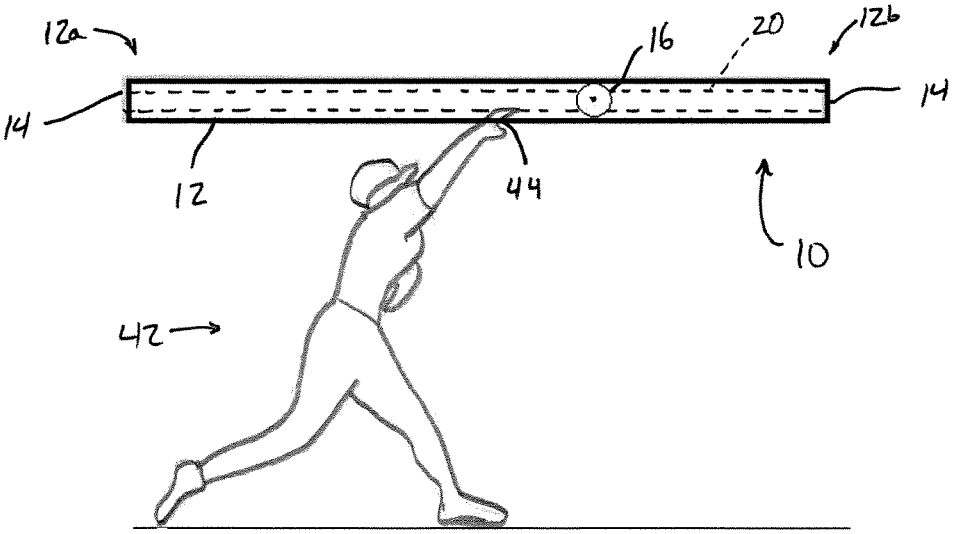

The user uses the training device 110 in a similar manner as training device 10 and described with reference to FIGS. 5A-C. When mounting the device 110 for use, the right angle plates 168 may be further coupled to a wall or fence, such as to increase the stability of the device 110. The hook-shaped brackets 162 may be coupled to the vertical support members 164 by hanging hook-shaped upper end portions 162*a* over respective portions of a fence. It is further envisioned that the device 110 could be mounted at an angle, with the guide track 114 in a non-level orientation, if desired. Optionally, the vertical support members 164 may be secured to substantially any suitable support using fasteners such as screws, bolts, or the like. As a further option, hook-shaped brackets 162 may attach to slots of wall-mounted members, such as square tube members or U-shaped rails with slots spaced along their length at different heights. When vertical support members 164 are not in use, each can be rotated parallel along the respective end member 116 to which it is mounted, while the end members 116 (with vertical support members 164) are further pivotable inwardly against the guide track 114, so that training device 110 is more compact for transportation or storage. End members 116 may also be removable and/or of a collapsible construction. Thus, the training device 10 is configurable to a collapsed configuration, such as for compact storage and/or transport, with the upright support members 164 adjacent the end members 116, and the end members 116 adjacent the first and second ends 114*a*, 114*b* of the guide track 114. It will be appreciated that in the collapsed configuration, the upright support members 164, the end members 116, and the guide track 114 define respective longitudinal axes that are substantially parallel and in close proximity to one another.

Therefore, the present invention provides a training device for teaching ball throwing technique, which guides a ball or ball substitute along an appropriate path for an overhand throw, such as for a baseball, softball, or the like. The device may be height adjustable to facilitate use by different persons, and can be readily installed at outdoor locations, without the use of separate supporting devices such as ground-supported stands or the like, such as by mounting to a chain-link fence or wall, and can also be located in areas where there is sufficient overhead structural support, such as in a basement in which the floor joist of a main level are exposed overhead. Through repeated throwing action using the training device, the user learns muscle memory for a desired overhand throwing technique, such as to facilitate accurate throwing of a free ball when the device is not in use. The device can be stored compactly, and can be sized to accommodate either one or two users at the same time.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A training device for ball throwing technique, said training device comprising:

an elongate guide track configured to be mounted in an elevated location, said guide track having first and second ends and a longitudinal guide track axis ($A_T$);

a ball mount having a track-engaging portion disposed at least partially around and movably coupled to said guide track, and a ball-engaging portion extending from and pivotably coupled to said track-engaging portion, wherein said ball mount is configured to be simultaneously freely rotatable about said longitudinal guide track axis ($A_T$) and freely translatable along said longitudinal guide track axis ($A_T$);

wherein said ball-engaging portion cooperates with said track-engaging portion to define a ball mount axis ($A_S$) that is angled relative to said longitudinal guide track axis ($A_T$), and wherein said ball-engaging portion is rotatable about said ball mount axis ($A_S$); and a ball coupled to said ball-engaging portion and rotatable about a ball rotation axis ($A_B$) defined by said ball-engaging portion, wherein said ball rotation axis ($A_B$) is (i) angled relative to said ball mount axis ($A_S$) and (ii) spaced from said longitudinal guide track axis ($A_T$);

wherein said ball is movably supported along said guide track by said ball mount and is manually throwable from said first end to said second end of said guide track.

2. The training device of claim 1, wherein said guide track is substantially linear.

3. The training device of claim 1, wherein said elongate guide track comprises a circular cross section and said track-engaging portion of said ball mount defines a circular bore for receiving said elongate guide track.

4. The training device of claim 1, wherein said ball-engaging portion of said ball mount comprises a ball strut having an upper end portion coupled to said track-engaging portion and a lower end portion coupled to said ball, and wherein said track-engaging portion of said ball mount comprises a strut mount to which said upper end portion of said ball strut is pivotably coupled.

5. The training device of claim 4, further comprising a pivot-stop element at said strut mount, said pivot-stop element configured to set a predetermined limited range of rotation of said ball strut in said strut mount.

6. The training device of claim 5, wherein said pivot-stop element comprises at least one selecting pin, and said strut mount defines first and second openings spaced apart from one another, each of said openings configured to receive said selecting pin, and wherein said ball strut is limited to pivot about only a first range of rotation along a first arc traced by said ball strut when said selecting pin is in said first opening, and said ball strut is limited to pivot about only a second range of rotation along a second arc traced by said ball strut when said selecting pin is in said second opening.

7. The training device of claim 6, further comprising a strut pin projecting outwardly from said ball strut and configured to selectively engage said selecting pin to thereby limit the range of rotation of said ball strut in said strut mount.

8. The training device of claim 6, wherein said first and second openings are positioned so that the first arc of said ball strut when said selecting pin is in said first opening is separate and distinct from the second arc of said ball strut when said selecting pin is in said second opening.

9. The training device of claim 4, wherein said strut mount comprises a pair of spaced-apart projections defining respective openings for receiving respective portions of said ball strut.

10. The training device of claim 4, wherein said ball strut comprises a generally L-shaped rod having said lower end portion angled relative to said upper end portion.

11. The training device of claim 10, wherein said ball defines a bore, and said ball-engaging portion of said ball mount further comprises a ball sleeve inserted into said bore and rotatably mounted at said lower end portion of said ball strut.

12. The training device of claim 1, wherein said track-engaging portion of said ball mount comprises a sliding block coupled to a side plate, wherein said sliding block defines an opening configured to slidably receive said guide track, and said track-engaging portion is coupled to said side plate.

13. The training device of claim 1, further comprising a support structure having at least two hook portions coupled to said guide track and configured to engage a substantially vertical support surface.

14. The training device of claim 13, wherein said support structure comprises a pair of end members extending at right angles to said first and second ends of said guide track, and a pair of upright support members extending upwardly from respective ones of said first and second ends of said guide track, wherein said at least two hook portions are disposed at upper end portions of respective ones of said upright support members.

15. The training device of claim 14, wherein said upright support members are pivotably coupled to said end members and said end members are pivotably coupled to said first and second ends of said guide track, whereby said training device is configurable to a collapsed configuration with said upright support members adjacent said end members and said end members adjacent said first and second ends of said guide track, and wherein said upright support members, said end members, and said first and second ends of said guide track each define respective longitudinal axes that are substantially parallel to one another in the collapsed configuration.

16. A training device for ball throwing technique, said training device comprising:

a support structure mountable to a vertical support surface;

an elongate guide track coupled to said support structure and having opposite ends and a longitudinal guide track axis ($A_T$);

a ball mount having a track-engaging portion disposed at least partially around said guide track and a ball strut having an upper end portion coupled to said track-engaging portion and a lower end portion extending away from said track-engaging portion, wherein said track-engaging portion is configured to be simultaneously movable along said longitudinal guide track axis ($A_T$) and freely rotatable about said longitudinal guide track axis ($A_T$), and wherein said ball strut is pivotable relative to said track-engaging portion about a ball mount axis ($A_S$) that is spaced from and angled relative to said longitudinal guide track axis ($A_T$); and a ball mounted at said ball strut and rotatable relative to said ball strut and said track-engaging portion about a ball rotational axis ($A_B$) that is spaced from said longitudinal guide track axis ($A_T$) and angled relative to said ball mount axis ($A_S$).

17. The training device of claim 16, wherein:

said ball is coupled to a lower end portion of said ball strut;

said track-engaging portion of said ball mount comprises a strut mount to which said upper end portion of said ball strut is pivotably coupled; and a pivot-stop element at said strut mount, said pivot-stop element configured to set a range of pivoting rotation of said ball strut in said strut mount.

18. The training device of claim 16, further comprising a pair of end members extending at right angles to said first and second ends of said guide track, a pair of upright support members extending upwardly from respective ones of said first and second ends of said guide track, and hook portions coupled to upper end portions of said upright support members, wherein said hook portions are configured to engage a support surface.

* * * * *